US007810955B2

(12) United States Patent
Stimac et al.

(10) Patent No.: US 7,810,955 B2
(45) Date of Patent: Oct. 12, 2010

(54) LINEAR LED ILLUMINATION SYSTEM

(75) Inventors: Tomislav Stimac, Concord, OH (US); Shawn Du, Macedonia, OH (US); Matthew S. Mrakovich, Streetsboro, OH (US); Mark Mayer, Sagamore Hills, OH (US)

(73) Assignee: Lumination LLC, Cleveland, OH (US)

( * ) Notice: Subject to any disclaimer, the term of this patent is extended or adjusted under 35 U.S.C. 154(b) by 0 days.

(21) Appl. No.: 11/780,154

(22) Filed: Jul. 19, 2007

(65) Prior Publication Data

US 2009/0021936 A1 Jan. 22, 2009

(51) Int. Cl.
*F21V 29/00* (2006.01)

(52) U.S. Cl. ..... 362/294; 362/373; 362/800; 362/249.01

(58) Field of Classification Search ..... 362/294, 362/373, 800
See application file for complete search history.

(56) References Cited

U.S. PATENT DOCUMENTS

| | | | | |
|---|---|---|---|---|
| 6,283,612 | B1 * | 9/2001 | Hunter | 362/240 |
| 6,502,952 | B1 * | 1/2003 | Hartley | 362/184 |
| 2005/0286265 | A1 * | 12/2005 | Zampini et al. | 362/612 |

OTHER PUBLICATIONS iW Profile, Color Kinetic Incorporated, www.colorkinetics.com, 9 pgs., (2004-2006).

* cited by examiner

*Primary Examiner*—Sandra L O'Shea
*Assistant Examiner*—Jessica L McMillan
(74) *Attorney, Agent, or Firm*—Fay Sharpe LLP

(57) ABSTRACT

A linear LED light module and system includes a heat sink, a printed circuit board, a plurality of LEDs, a power supply housing, a flexible electrical conductor, a first electrical connector, a second electrical connector, and a power supply. The heat sink is elongated in an axial direction along a longitudinal axis that is parallel with a greatest dimension of the heat sink. The PCB is in thermal communication with the heat sink and includes circuitry. The plurality of LEDs mount to the PCB and are in electrical communication with the circuitry of the PCB. The power supply housing connects to the heat sink. The flexible electrical conductor includes at least two wires that are configured to accommodate an AC line voltage of at least 120 VAC. The first electrical connector is at a first end of the electrical conductor. The second electrical connector is at a second end of the electrical conductor. The second connector has a configuration that complements the first connector so that the second connector can connect to an associated adjacent first connector of an associated adjacent LED module to allow a plurality of similar LED modules to be mechanically and electrically connected to one another. The power supply is disposed in the power supply housing and in electrical communication with the circuitry of the PCB and the electrical conductor. The power supply is configured to receive the AC line voltage from the electrical conductor and to convert the received AC line voltage to a lower DC voltage for delivery to the circuitry of the PCB to drive the LEDs mounted on the PCB.

16 Claims, 4 Drawing Sheets

LINEAR LED ILLUMINATION SYSTEM

BACKGROUND

Linear light systems are popular for display and architectural applications. Oftentimes linear light sources are used in cove lighting applications. In cove lighting applications, fluorescent lights and neon lights are used for linear lighting because of the long thin tube that emits light in both neon light and fluorescent light systems. Neon lights and fluorescent lights, however, use more energy and do not last as long as light emitting diodes (LEDs).

Light emitting diodes are semiconductor devices that are forward biased to generate light. Because of this forward bias, LEDs are often operated using direct current. Where LED linear light sources have been used to replace fluorescent and neon lights for linear lighting applications, one external power source is provided to deliver DC power to drive the LEDs in a plurality of separate LED modules. This setup can be complicated and time consuming to install.

SUMMARY

A linear LED light module and system that overcomes the aforementioned disadvantages includes a heat sink, a printed circuit board, a plurality of LEDs, a power supply housing, a flexible electrical conductor, a first electrical connector, a second electrical connector, and a power supply. The heat sink is elongated in an axial direction along a longitudinal axis that is parallel with a greatest dimension of the heat sink. The PCB is in thermal communication with the heat sink and includes circuitry. The plurality of LEDs mount to the PCB and are in electrical communication with the circuitry of the PCB. The power supply housing connects to the heat sink. The flexible electrical conductor includes at least two wires that are configured to accommodate an AC line voltage of at least 120 VAC. The first electrical connector is at a first end of the electrical conductor. The second electrical connector is at a second end of the electrical conductor. The second connector has a configuration that complements the first connector so that the second connector can connect to an associated adjacent first connector of an associated adjacent LED module to allow a plurality of similar LED modules to be mechanically and electrically connected to one another. The power supply is disposed in the power supply housing and in electrical communication with the circuitry of the PCB and the electrical conductor. The power supply is configured to receive the AC line voltage from the electrical conductor and to convert the received AC line voltage to a lower DC voltage for delivery to the circuitry of the PCB to drive the LEDs mounted on the PCB.

DETAILED DESCRIPTION

Figure 1:
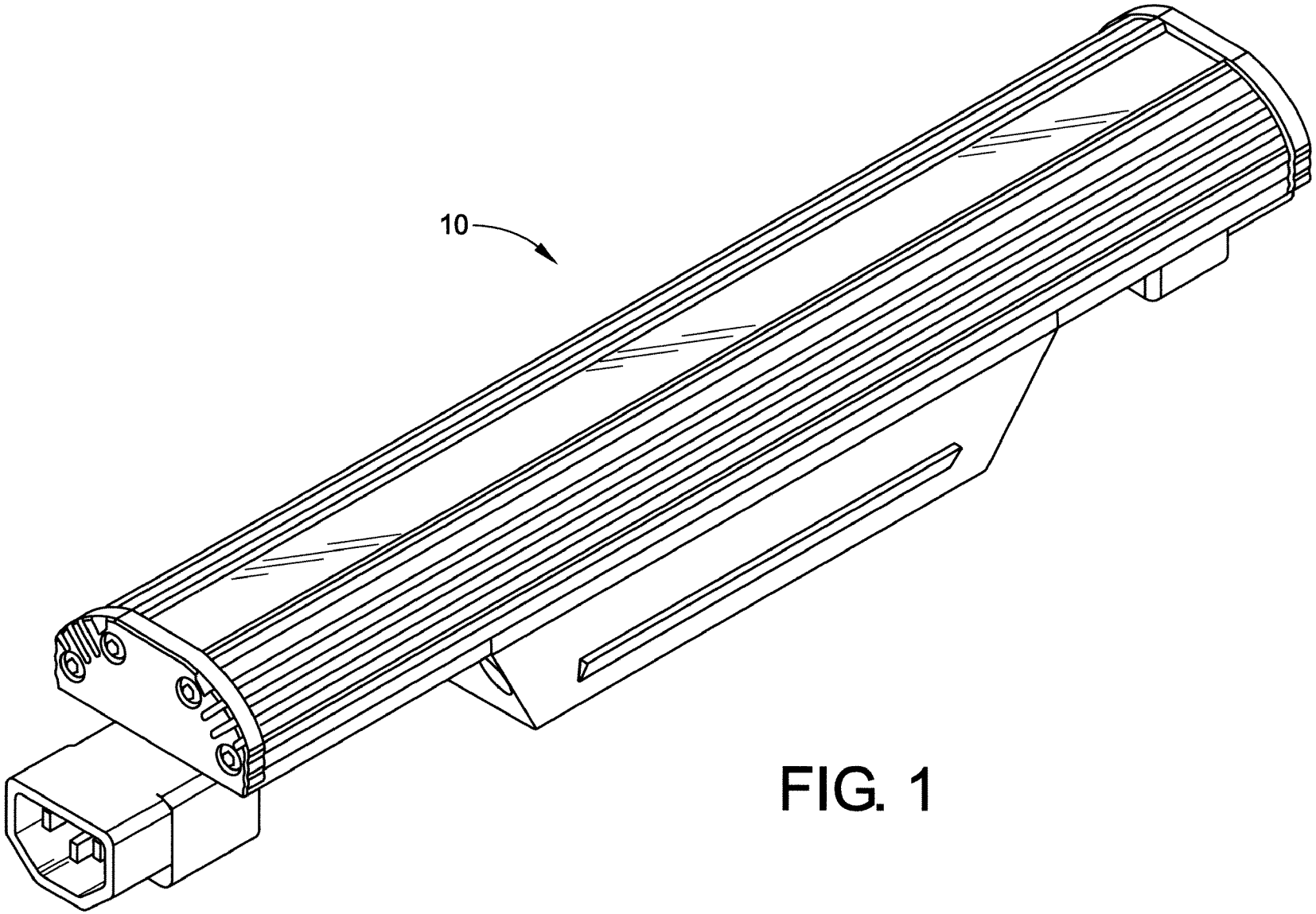
FIG. 1 is a perspective view of an elongate linear LED module.

With reference to FIG. 1, an elongate linear light emitting diode (LED) module 10 is shown that is useful where linear lighting is desired, for example in cove lighting as well as architectural displays and the like. The LED module can be used in other applications. The LED module includes a self-contained AC/DC power supply, passive thermal management and beam control optics. The LED module is designed to enable quick and easy connections and installation of a plurality of LED modules in a line to provide a linear LED system. Each module 10 can mechanically and electrically attach to an adjacent module and pass the AC bus so that the modules can be simply plugged into a conventional wall socket and receive line voltage without having to pass the power between the line voltage output of the wall socket and the input of each module through a power conditioner that drives a plurality of LED modules, such as those that are known in the art. The design is scalable in length to provide a six inch module or a module up to at least about eight feet.

Figure 2:
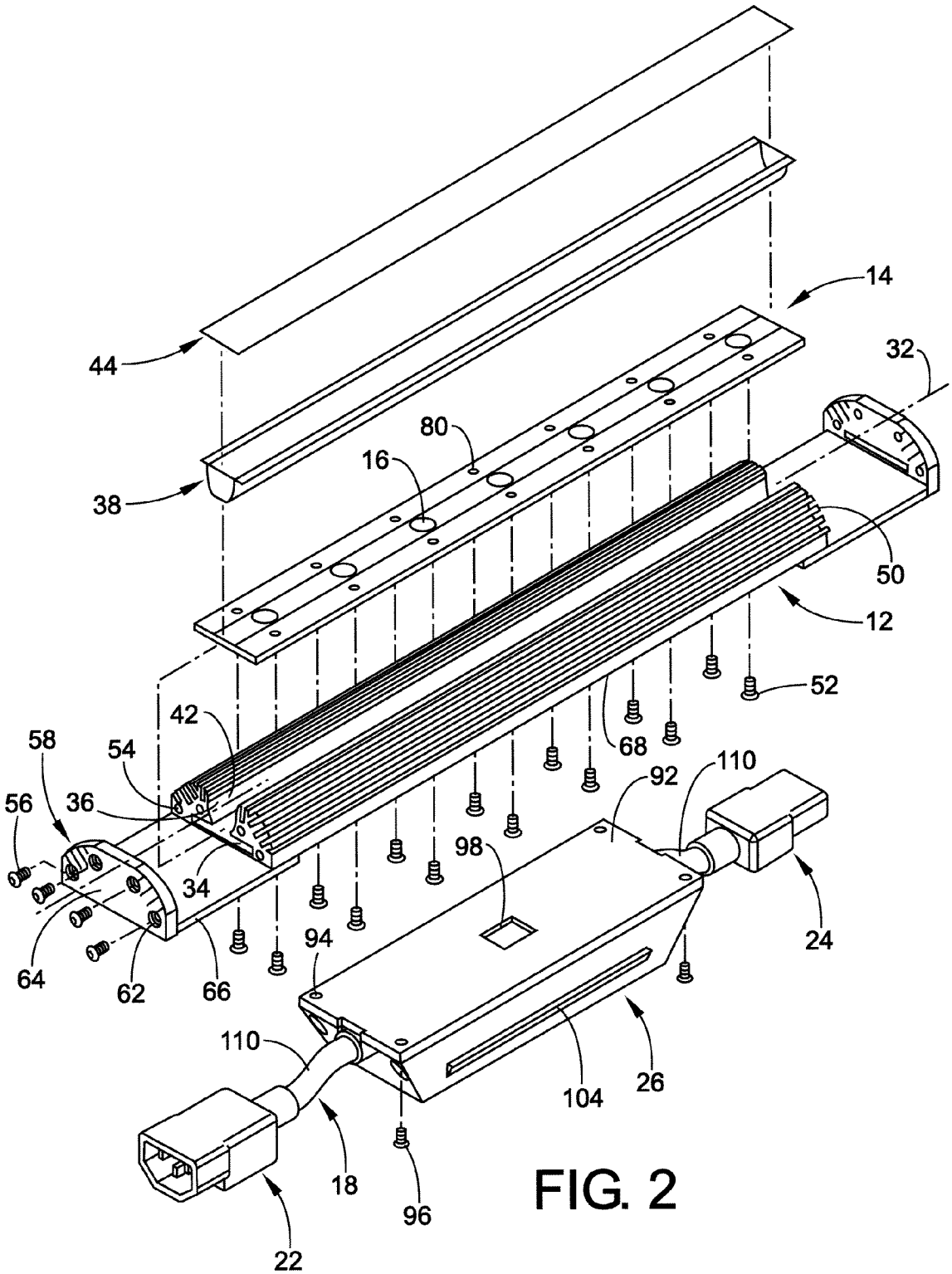
FIG. 2 is an exploded view of the module shown in FIG. 1.

With reference to FIG. 2, the elongate linear LED module includes an elongate heat sink 12, an elongate printed circuit board (PCB) 14, a plurality of light emitting diodes (LEDs) 16 mounted to the PCB, a flexible electrical conductor 18, a first (female) electrical connector 22 at a first end of the electrical conductor 18, a second (male) electrical connector 24 at a second end of the electrical conductor 18, a power supply housing 26 and a power supply 28 (FIG. 5) disposed in the power supply housing. The heat sink 12 is elongated in an axial direction along a longitudinal axis 32 that is parallel with a greatest dimension of the heat sink. The heat sink includes an elongate channel having a first section 34 that receives the PCB 14 and a second section 36 that is open to the first section and extends radially (perpendicular to the longitudinal axis 32) through the heat sink 12 away from the first section 34. The second section 36 of the heat sink channel is configured to receive and does receive an elongate optic 38 that is elongated in the axial direction. Opposite radial surfaces 42 that define the sides of the second section 36 of the heat sink channel can be reflective to redirect light that contacts these surfaces back into the optic 38. Where the heat sink 12 is made of aluminum, these reflective surface 42 can be highly polished. Additionally, these reflective surfaces can be the result of a tape or film being attached to or deposited on the heat sink 12 at the surfaces 42. The reflective surfaces 42 can abut the sides of the optic when the optic 38 is received in the heat sink channel.

The optic 38 can be made from a material having a high refractive intex for internally reflecting light entering the optic from the LEDs 16. The material can also result in a high dispersion of reflective light. Alternatively, the elongate optic 38 can be extruded and include a wave optic disposed in the extruded optic. When disposed in the second section 36 of the heat sink channel, the optic 38 is covered by a translucent cover 44 between the optic 38.

The heat sink 12 also includes a plurality of elongate fins 50 that radiate away from the heat sink channel. The fins 50 extend axially from a first end of the heat sink to the second end of the heat sink and provide a larger surface area to promote heat transfer into ambient via convection. Heat from the LEDs 16 dissipates into ambient through the heat sink. The heat sink 12 also includes openings (not visible) for receiving fasteners 52 for attaching the PCB 14 to the heat sink 12. The heat sink also includes openings 54 formed in each end face (the face that is normal to the longitudinal axis 32) for receiving fasteners 56 to attach end plates 58 to each end of the heat sink. Each end place 58 includes corresponding openings 62 that align with the openings 54 in the heat sink to receive the fasteners 56 to attach each end cover 58 to a respective end face of the heat sink 12.

Figure 3:
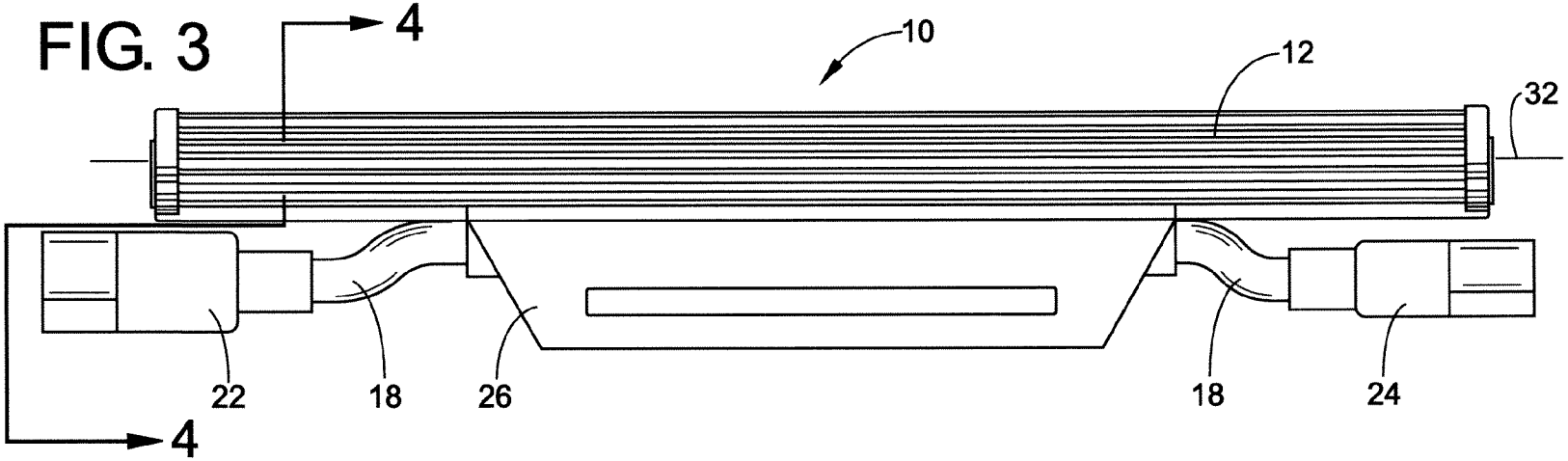
FIG. 3 is a side elevation view of the module shown in FIG. 1.

Each end cover 58 includes a vertical section 64 that abuts each end face and includes the opening 62. Each end cap 58 also includes a horizontal section 66 that extends away from the vertical section 64 and is received underneath a lowermost surface 68 of the heat sink 12. The vertical section 64 of each heat sink 58 traps the PCB 14 and the optic 38 in the heat sink channel and precludes the PCB and the optic from moving in the axial direction. The horizontal section 66 of each end cap contacts the power supply housing 26 (see FIG. 3).

Figure 4:
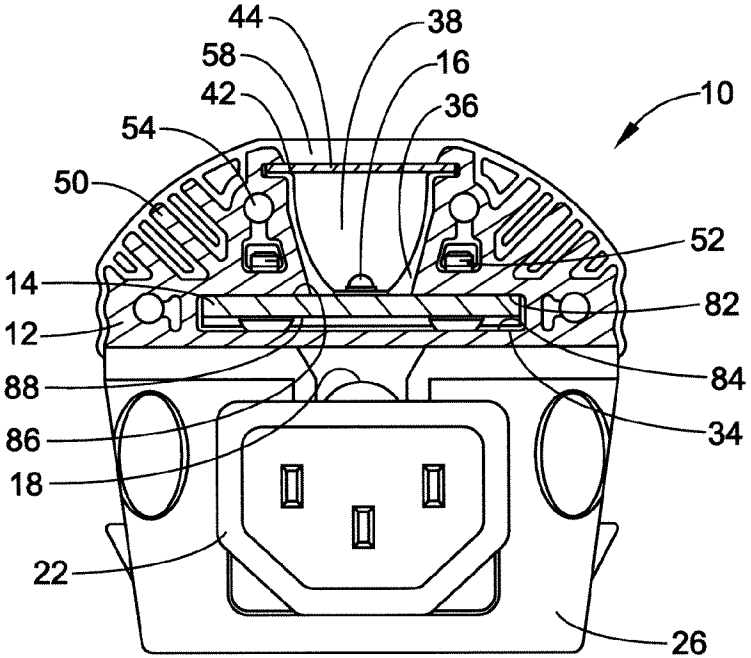
FIG. 4 is a cross-sectional view taken along line 4-4 in FIG. 3.

With reference back to FIG. 2, the PCB 14 in the depicted embodiment is a metal core printed circuit board. It is desirable that the PCB 14 include a material that allows the heat from the LED 16 to quickly transfer into the heat sink 12. The PCB 14 includes a plurality of openings 80 that align with the openings (not visible) in the lowermost surface 68 of the heat sink 12 to receive the fasteners 52 for attaching the PCB 14 to the heat sink 12. With reference to FIG. 4, the heat sink 12 includes an upper channel surface 82 and a lower channel surface 84 that is spaced from the upper channel surface 82 to define the first section 34 of the heat sink channel. Openings (not visible) are formed in the upper channel surface 82 so that the fasteners 52 are received therethrough so that an upper surface 86 of the printed circuit board 14 abuts the upper channel surface 82 to allow for a thermal path between the upper surface of the PCB and the heat sink 12. This allows the heat to more quickly travel towards the fins 50 of the heat sink 12 and travel away from the power supply 28 (FIG. 5) found in the power supply housing 26.

As most evident in FIG. 4, a lower surface 88 of the PCB14 is spaced from the lower channel surface 84. If desired, a thermal tape or other thermally conductive filler material can be interposed between the lower surface 88 of the PCB 14 and the lower channel surface 84. Nevertheless, the spacing between the lower surface of the PCB and the lower channel surface 84 may be desirable to provide a thermal barrier between the two so that heat is radiated towards the fins 50 of the heat sink 12 and not towards the power supply housing 26.

The power supply housing 26 includes a planar upper surface 92 that abuts against the lowermost surface 68 of the heat sink 12. Openings 94 are provided through the power supply housing 26 and receive fasteners 96 for attaching the power supply housing 26 to the heat sink 12. An opening 98, which in the depicted embodiment provides access into the hollow compartment of the power supply housing 26, is provided to allow wires 102 (FIG. 5) that are in electrical communication with the power supply 28 to extend through an opening (not visible) through the lower portion of the heat sink 12 to provide electrical power to the PCB 14. The power supply housing 26 is made of a durable electrically insulative material, such as plastic. Elongate barbs 104 that are elongated along the longitudinal axis 32 are provided on opposite sides of the power supply housing 26. The barbs 104 engage a channel in which the LED module is received when the LED module is used in a linear light system.

With reference back to FIG. 2, the flexible electrical conductor 18 includes portions that extend outwardly from the power supply housing 26. A protective sheath 110 protects the wires 112 (positive, negative and ground wires depicted schematically in FIG. 5) from where the wires extend from the power supply housing 22 to where the wires are surrounded by the protective cover of the respective connectors 22 and 24. The embodiment depicted shows one conductor extending through the power supply housing 26 between the female connector 22 and the male connector 24. Alternatively, one conductor can extend from the female connector 22 to the power supply 28 and another conductor can extend from the power supply to the male connector 24.

The connectors 22 and 24 are configured to accommodate line voltage, e.g. 120 VAC, 220 VAC, which allows the LED module 10 to simply be plugged into a conventional wall outlet via a cord 120 including a plug 122 that is configured to plug into a conventional wall socket and a connector 124 that are interconnected by wires 126. The connector 124 is configured to mechanically and electrically connect to one of the connectors, either the connector 22 or connector 24. Accordingly, the LED module 10 can be driven directly from line voltage, which makes the LED module much simpler to install than known modules.

Figure 5:
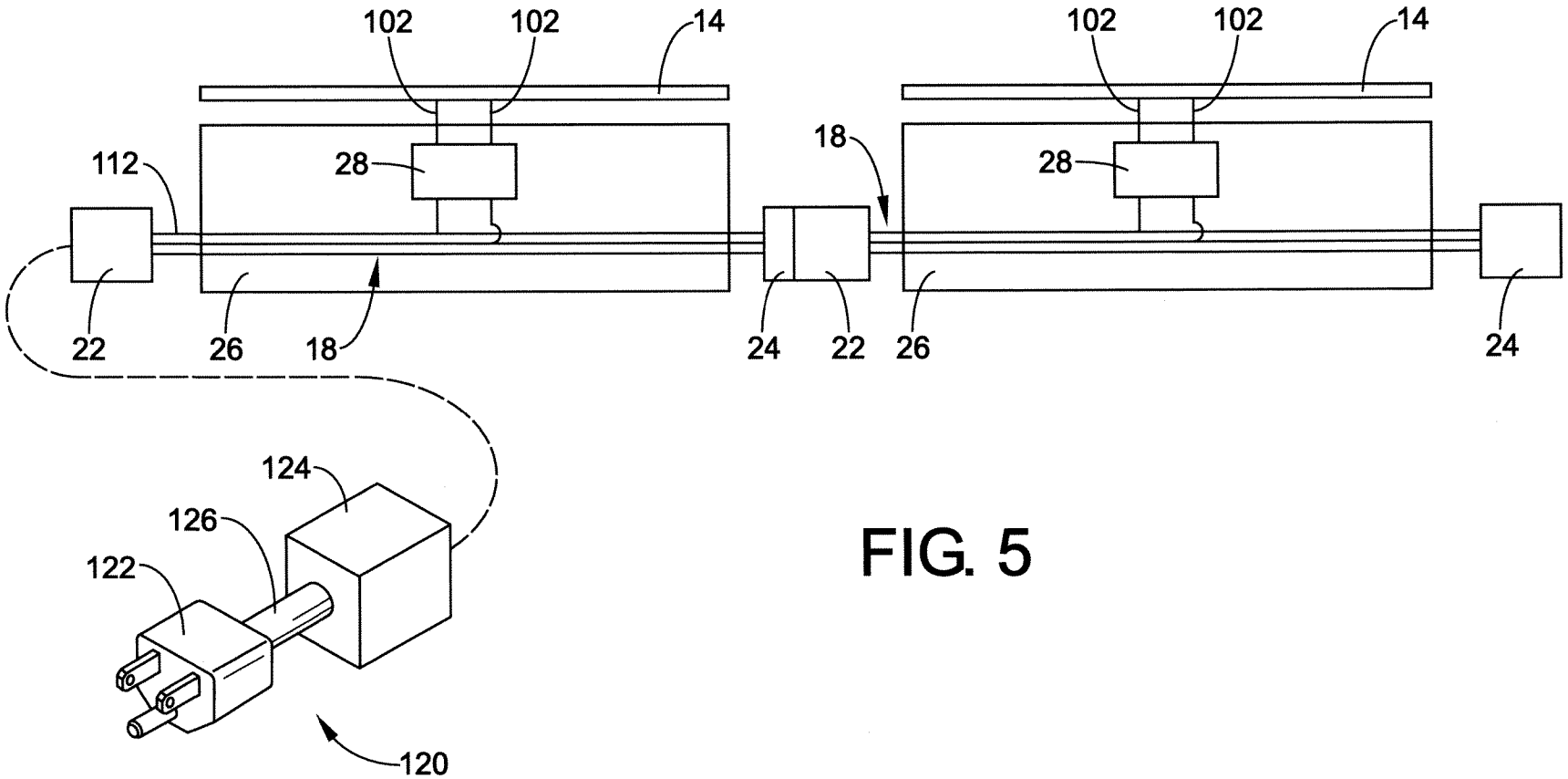
FIG. 5 is a schematic view of two LED modules that are the same as the module shown in FIG. 1 mechanically and electrically connected to one another.

The first electrical connector includes a plurality of prongs that each attach to a respective wire 112 (FIG. 5). The second connector 24 includes a plurality of receptacles (not visible) that are attached to a respective wire and are also configured to receive the prongs 130 so that the first connector 22 from one LED module can electrically and mechanically attach to the second connector of an adjacent LED module. For example, as shown in FIG. 5, the female connector 22 is configured to mechanically and electrically connect to an adjacent male connector 24 of an adjacent LED module so that a plurality of LED modules 10 can be strung together.

The power supply 28 is configured to convert the higher voltage AC to a lower voltage DC for delivery to the PCB 14. The limiting factors in the design are the current carrying capacity of the wires 102, 112, and 126 and the circuit breaker limit for the breaker box to which the system is electrically connected. The power supply in each module passes the AC bus between the modules which obviates the need for complicated power supply.

A linear light emitting diode module and system have been described with great particularity with reference to aforementioned embodiment. The invention is not limited to only the embodiment disclosed. Instead, the invention is broadly defined by the appended claims and the equivalents thereof.

The invention claimed is:

1. An elongate linear light emitting diode (LED) module comprising:

a heat sink elongated in an axial direction along a longitudinal axis that is parallel with a greatest dimension of the heat sink;

a printed circuit board (PCB) in thermal communication with the heat sink and including circuitry;

a plurality of LEDs mounted to the PCB and in electrical communication with circuitry of the PCB, the LEDs being spaced from one another in the axial direction;

a power supply housing connected to the heat sink;

a flexible electrical conductor including at least two wires and configured to accommodate an AC line voltage of at least 120 VAC;

a first electrical connector at a first end of the electrical conductor;

a second electrical connector at a second end of the electrical conductor, the second connector having a configuration that complements the first connector so that the second connector can connect to an associated adjacent first connector of an associated adjacent LED module to allow a plurality of similar LED modules to be mechanically and electrically connected to one another;

a power supply disposed in the power supply housing and in electrical communication with the circuitry of the PCB and the electrical conductor, the power supply configured to receive the AC line voltage from the electrical conductor and to convert the received AC line voltage to a lower DC voltage for delivery to the circuitry of the PCB to drive the LEDs mounted on the PCB; and elongate barbs extending in the axial direction disposed on opposite sides of the power supply housing, the barbs being configured to engage an associated channel for mounting the LED module.

2. An elongate linear light emitting diode (LED) module comprising:

a printed circuit board (PCB) in thermal communication with the heat sink and including circuitry;

a heat sink elongated in an axial direction along a longitudinal axis that is parallel with a greatest dimension of the heat sink, wherein the heat sink is in thermal communication with PCB, wherein the heat sink includes an elongate channel extending in the axial direction having a first section that receives the PCB and a second section open to the first section and extending radially through the heat sink away from the first section;

a plurality of LEDs mounted to the PCB and in electrical communication with circuitry of the PCB, the LEDs being spaced from one another in the axial direction;

a power supply housing connected to the heat sink;

a flexible electrical conductor including at least two wires and configured to accommodate an AC line voltage of at least 120 VAC;

a first electrical connector at a first end of the electrical conductor;

a second electrical connector at a second end of the electrical conductor, the second connector having a configuration that complements the first connector so that the second connector can connect to an associated adjacent first connector of an associated adjacent LED module to allow a plurality of similar LED modules to be mechanically and electrically connected to one another; and a power supply disposed in the power supply housing and in electrical communication with the circuitry of the PCB and the electrical conductor, the power supply configured to receive the AC line voltage from the electrical conductor and to convert the received AC line voltage to a lower DC voltage for delivery to the circuitry of the PCB to drive the LEDs mounted on the PCB.

3. The module of claim 2, further comprising an elongate optic elongated in the axial direction and received in the second section of the channel, the elongate optic having a high refractive index for internally reflecting light entering the optic from the LEDs and a high dispersion of reflected light.

4. The module of claim 3, wherein the heat sink includes reflective surfaces adjacent the second section of the channel, the reflective surfaces facing the optic for redirecting light that contacts the reflective surfaces back into the optic.

5. The module of claim 4, wherein the heat sink includes reflective surfaces adjacent the second section of the channel, the reflective surfaces facing the optic for redirecting light that contacts the reflective surfaces back into the optic.

6. The module of claim 2, further comprising an elongate optic elongated in the axial direction and received in the second section of the channel, the elongate optic being extruded and including a wave optic in the optic.

7. The module of claim 2, further comprising an elongate optic elongated in the axial direction and received in the second section of the channel.

8. The module of claim 7, wherein the first section of the channel is defined by an upper channel surface and a lower channel surface spaced from the upper channel surface, an upper surface of the PCB abuts the upper channel surface to provide a thermal path between the upper surface of the PCB and the upper channel surface.

9. The module of claim 8, wherein the power supply housing abuts against a lowermost surface of the heat sink, the lower channel surface being interposed between the upper channel surface and the lowermost surface of the heat sink.

10. The module of claim 9, wherein a lower surface of the PCB is spaced from the lower channel surface.

11. The module of claim 10, wherein the heat sink includes axially extending fins that radiate away from the channel.

12. An elongate linear light emitting diode (LED) module comprising:

a heat sink elongated in an axial direction along a longitudinal axis that is parallel with a greatest dimension of the heat sink;

a printed circuit board (PCB) in thermal communication with the heat sink and including circuitry;

a plurality of LEDs mounted to the PCB and in electrical communication with circuitry of the PCB, the LEDs being spaced from one another in the axial direction;

a power supply housing connected to the heat sink;

a flexible electrical conductor including at least two wires and configured to accommodate an AC line voltage of at least 120 VAC;

a first electrical connector at a first end of the electrical conductor;

a second electrical connector at a second end of the electrical conductor, the second connector including three receptacles, each being connected to a respective wire and configured to accommodate 120 VAC and further having a configuration that complements the first connector so that the second connector can connect to an associated adjacent first connector of an associated adjacent LED module to allow a plurality of similar LED modules to be mechanically and electrically connected to one another;

a power supply disposed in the power supply housing and in electrical communication with the circuitry of the PCB and the electrical conductor, the power supply configured to receive the AC line voltage from the electrical conductor and to convert the received AC line voltage to a lower DC voltage for delivery to the circuitry of the PCB to drive the LEDs mounted on the PCB; and a protective sheath covering a portion each wire of the electrical conductor disposed outside of the power supply housing.

13. The module of claim 12, wherein the first electrical connector includes three prongs, each prong being connected to a respective wire and configured to accommodate 120 VAC.

14. A linear light emitting diode (LED) system comprising a plurality of interconnected LED modules, each module comprising:

an elongate heat sink defining a longitudinal axis running parallel to a greatest dimension of the heat sink, the heat sink including a channel extending through the heat sink from a first end to a second end along the longitudinal axis of the heat sink;

an optic elongated in a direction parallel to the longitudinal axis disposed in the channel;

a printed circuit board (PCB) elongated in a direction parallel to the longitudinal axis disposed in the channel and in thermal communication with the elongate heat sink, the PCB including circuitry;

a plurality of LEDs mounted to the PCB and in electrical communication with circuitry of the PCB, the LEDs being spaced from one another in a direction parallel to the longitudinal axis;

a power supply housing connected to a lowermost surface of the elongate heat sink;

a female electrical connector spaced from the power supply housing;

a male electrical connector spaced from the power supply housing, the male connector having a configuration that complements the female connector so that the male connector of a first LED module of the plurality of LED modules connects to a female connector of a second LED module of the plurality of LED modules to mechanically and electrically connect the first LED module to the second LED module;

a flexible electrical conductor having at least two wires interconnecting the female electrical connector and the male electrical connector, the flexible electrical conductor being configured to accommodate a line voltage of at least 120 VAC; and a power supply disposed in the power supply housing and in electrical communication with the circuitry of the PCB and the electrical conductor, the power supply configured to receive the AC line voltage from the electrical conductor and to convert the received AC line voltage to a lower DC voltage for delivery to the circuitry of the PCB to drive the LEDs.

15. The system of claim 14, further comprising an electrical cord including a plug configured to plug into a conventional wall socket and an electrical connector configured to electrically and mechanically connect with at least one of the male electrical connector and the female electrical connector.

16. A linear LED light system comprising a plurality of LED modules wherein each module includes an integral power supply and a plurality of LEDs driven by the power supply, wherein the power supply is configured to receive AC line voltage and to deliver a lower DC voltage to the LEDs to drive the LEDs while allowing the AC line voltage to be delivered to an adjacent LED module.

* * * * *